United States Patent [19]

Danielson et al.

[11] 4,398,074

[45] Aug. 9, 1983

[54] LOW PROFILE SWITCH HAVING A SEALED INTERIOR

[75] Inventors: David J. Danielson, McHenry; Bernard J. Golbeck, Crystal Lake, both of Ill.

[73] Assignee: Oak Industries Inc., Rancho Bernardo, Calif.

[21] Appl. No.: 272,899

[22] Filed: Jun. 12, 1981

[51] Int. Cl.[3] ..... H01H 13/06; H01H 13/64

[52] U.S. Cl. ..... 200/302; 200/159 B

[58] Field of Search ..... 200/159 A, 159 B, 67 D, 200/67 DA, 67 DB, 302

[56] References Cited

U.S. PATENT DOCUMENTS

| | | | |
|---|---|---|---|
| 2,192,296 | 3/1940 | Boynton | 200/159 B |
| 2,409,483 | 10/1946 | Gandetot | 200/159 B |
| 3,041,430 | 6/1962 | Helts | 200/302 |
| 3,087,341 | 4/1963 | Hults | 200/302 |
| 3,908,109 | 9/1975 | Studebaker | 200/159 B |
| 3,982,089 | 9/1976 | Hyltin | 200/159 B |
| 3,996,428 | 12/1976 | Baun et al. | 200/159 B |
| 4,056,700 | 11/1977 | Stannek | 200/159 A |
| 4,145,588 | 3/1979 | Orcutt | 200/302 |
| 4,217,473 | 8/1980 | Parkinson | 200/159 B |

FOREIGN PATENT DOCUMENTS

| | | | |
|---|---|---|---|
| 1059072 | 6/1959 | Fed. Rep. of Germany | 200/302 |

*Primary Examiner*—Stephen Marcus
*Assistant Examiner*—Ernest G. Cusick
*Attorney, Agent, or Firm*—Kinzer, Plyer, Dorn & McEachran

[57] ABSTRACT

A low profile switch has a base with a contact pin extending through the base. The pin is press fit into a hole in the base such that the pin itself seals that hole. A movable contact including a central dome portion overlies the contact pin. The dome portion is movable into and out of contact with the pin. A gasket is disposed between the periphery of the movable contact and the base. A retainer clamps the movable contact against the gasket and urges the gasket into sealing engagement with the base to provide a sealed interior for the switch. The retainer has legs which are clinched on the under side of the base. A slidable button provides an actuating member.

8 Claims, 11 Drawing Figures

Fig. 6.
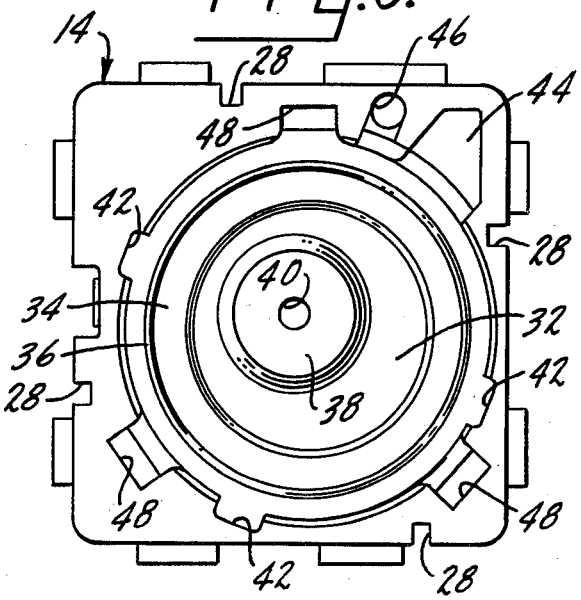
Fig. 7.
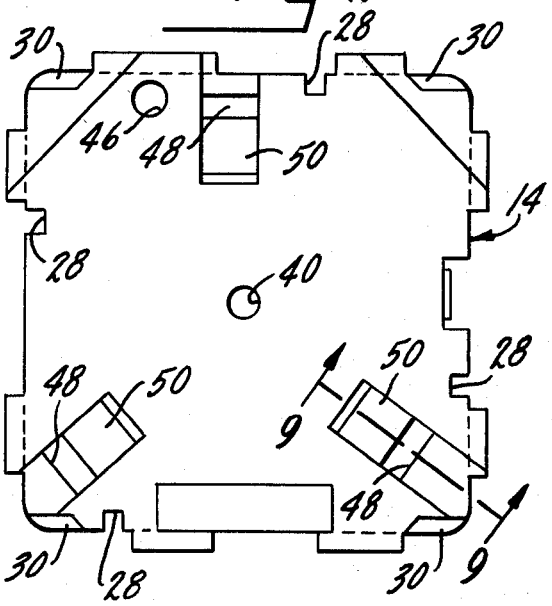
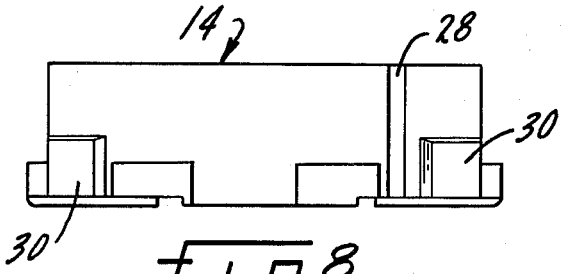
Fig. 8.
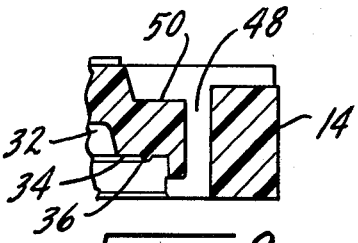
Fig. 9.
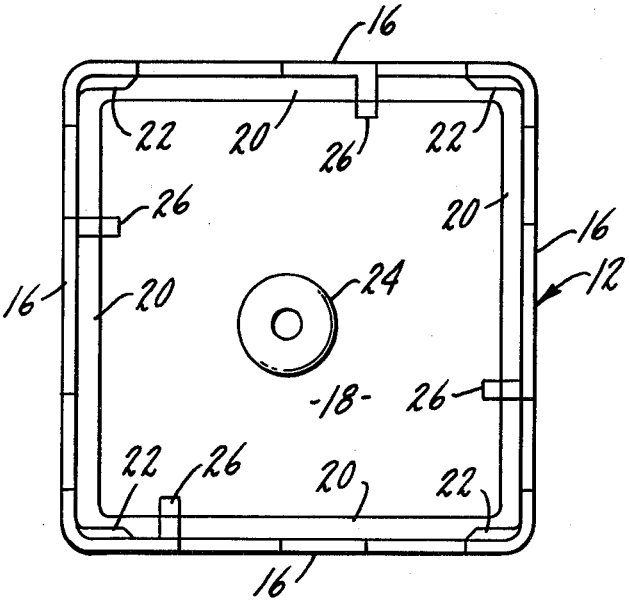
Fig. 10.
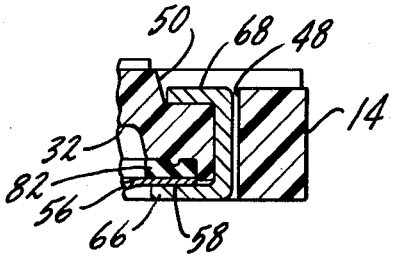
Fig. 11.

LOW PROFILE SWITCH HAVING A SEALED INTERIOR

SUMMARY OF THE INVENTION

This invention relates to electric switches and is particularly concerned with small, low profile switches for use in conjunction with printed circuit boards and the like.

A primary object of the present invention is electric switch having a sealed interior.

Another object is a sealing arrangement for an electric switch which does not require insert molding of metal contacts in plastic parts.

Another object is an electric switch with a sealed interior formed using a minimum number of parts.

Another object is an electric switch with a sealed interior and a low profile.

Another object is a low profile switch having a movable dome contact with a load-spreading device placed on the dome.

Other objects will appear in the following specification, drawings and claims.

BRIEF DESCRIPTION OF THE DRAWINGS

FIG. 6 is a top, plan view of the switch base.

FIG. 7 is a bottom, plan view of the switch base.

FIG. 8 is an elevation view of the switch base.

FIG. 9 is section taken substantially along line 9—9 of FIG. 7.

FIG. 10 is a bottom, plan view of the switch button.

FIG. 11 is a view similar to FIG. 9, showing the retainer legs in the clinched position.

DESCRIPTION OF A PREFERRED EMBODIMENT

Economic incorporation of electro-mechanical switches in printed circuit boards, control panels, calculators and the like has led to the use of wave soldering techniques for connecting the switches to the board. When this technique is used the switches involved must be capable of withstanding rather severe environmental conditions. In particular, the switch contacts must be isolated from the exterior of the switch otherwise the soldering flux will coat the contacts and thereby destroy the switch. Also, the switch must withstand the cleaning solvent which is used to remove excess flux.

Providing a sealed interior has been a problem in the small switches of the type contemplated by the present invention. The switch disclosed herein is on the order of a half-inch square and about a quarter-inch high. One approach to the problem has been to attempt to insert mold the switch contacts into a housing. However, providing a reliable seal in commercial quantities by this method has proven to be extremely difficult. In addition, attempts to ultrasonically weld contacts into a sealing member have not been successful. The present invention is directed to a switch which avoids the use of insert molding while providing a seal that is relatively simple to construct and assemble, yet is highly effective in operation.

Figure 1:
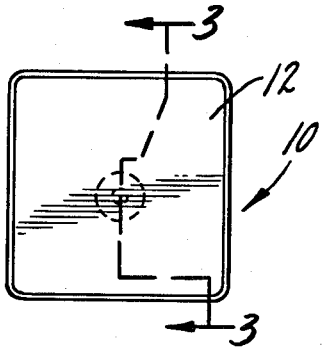
FIG. 1 is a plan view of the electric switch of the present invention.
Figure 2:
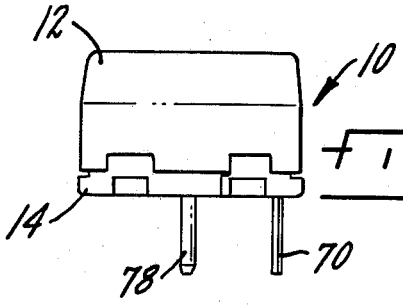
FIG. 2 is a side elevation view of the switch.

The outline of the switch is shown in FIGS. 1 and 2. The switch 10 includes a button 12 which is slidable on a base 14. A pair of electrical leads extend from the bottom of the base as seen in FIG. 2.

Details of the button and the base are shown in FIGS. 6–10. Looking first at FIG. 10, the button 12 is a square shell having walls 16 and a top 18. Each wall 16 has a ledge 20 on the interior side, approximately midway between the top 18 and the bottom edge of the wall. Where the walls 16 meet at the corners of the button there are hooks 22 formed near the bottom edge of the walls. These hooks engage the base in a manner which will be explained below. The hooks hold the button on the base. An actuating member 24 depends from the underside of the top 18. The actuating member applies pressure to the movable contact of the switch in response to user-supplied pressure on the button. The button is made of a suitable plastic material.

Each of the button walls 16 has an inwardly-extending rib 26. The ribs are slidable in vertical grooves 28 formed in the sides of the base 14 (see FIGS. 6–8). The intermeshing ribs and grooves guide the button during its actuating and return strokes.

The base 14 has near its corners four recesses 30. Once the button is placed in position on the base, the recesses capture the hooks 22 of the button. The hooks are free to move only to the extent of the recesses 30. Thus the recesses define the limit of upward movement of the button. Similarly, the ledges 20 define the limit of downward movement when they engage the top edge surfaces of the base.

Looking at FIG. 6, the base 14 has a central well or depression 32. Inside the well is a circular ledge 34. A bead 36 is placed on top of the ledge. Near the middle of the well 32 but offset from the center of the circular ledge 34 is a pedestal 38. A hole 40 extends through the pedestal to provide access to the well portion from the under side of the base. Three clearance notches 42 are cut into the base down to the level of the ledge 34. There is also an enlarged cut out 44. A second hole 46 through the base is provided for an electrical lead as will be explained below. Three retainer slots 48 are cut through the base. As seen in FIGS. 7 and 9 the retainer slots 48 terminate at an undercut portion 50 on the bottom side of the base. The base is formed of thermoplastic polyester.

Figure 4:
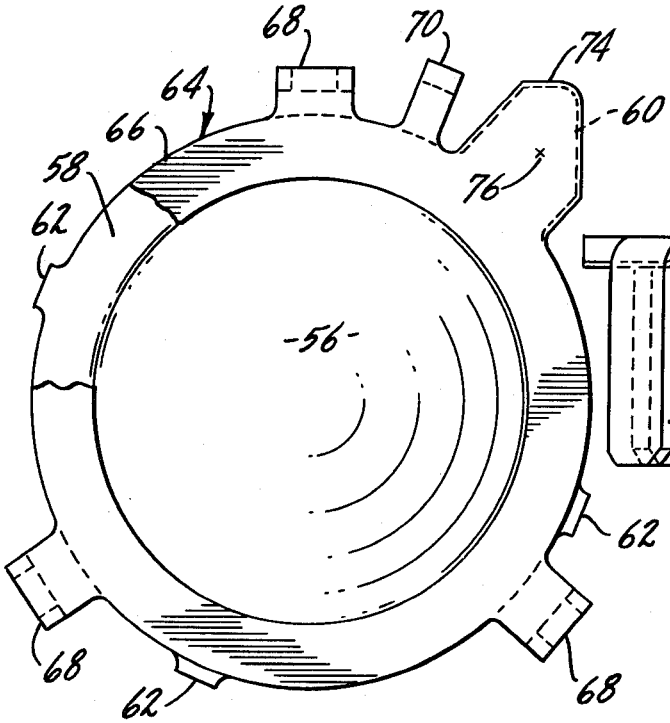
FIG. 4 is an enlarged, plan view of the movable contact and retainer means.
Figure 5:
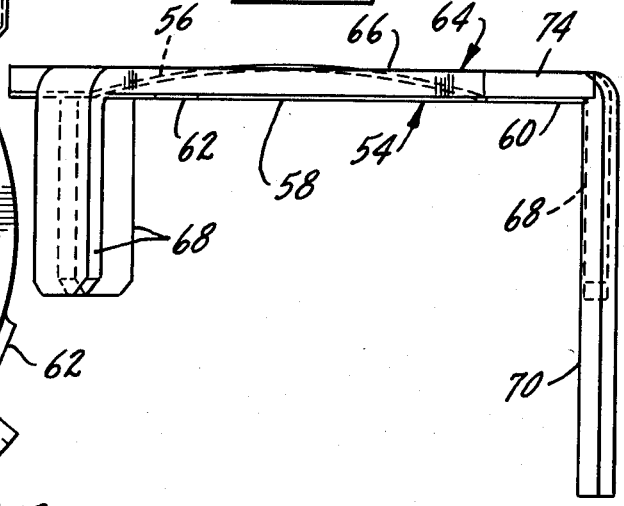
FIG. 5 is an elevation view of the movable contact and retainer means, prior to assembly.

FIGS. 4 and 5 show the movable contact and its retainer means. The contact 54 includes a central dome portion 56 which is contoured and flexible. Integral with the dome portion is a peripheral flange portion 58. There is also a connection tab 60 extending from one edge of the flange 58. Tabs 62 extend radially from the flange, in the same plane as the flange.

Retainer means 64 has a circular rim 66 which is symmetrical to the contact flange 58. Three legs 68 depend from the retainer rim 66. Also, there is an electrical lead 70 depending from the rim 66. A connection tab 74 overlies the similar tab 60 of the movable contact. The connection tabs 60 and 74 may be spot welded as at 76 to insure mechanical and electrical connection between the movable contact 54 and the retainer means 64.

Figure 3:
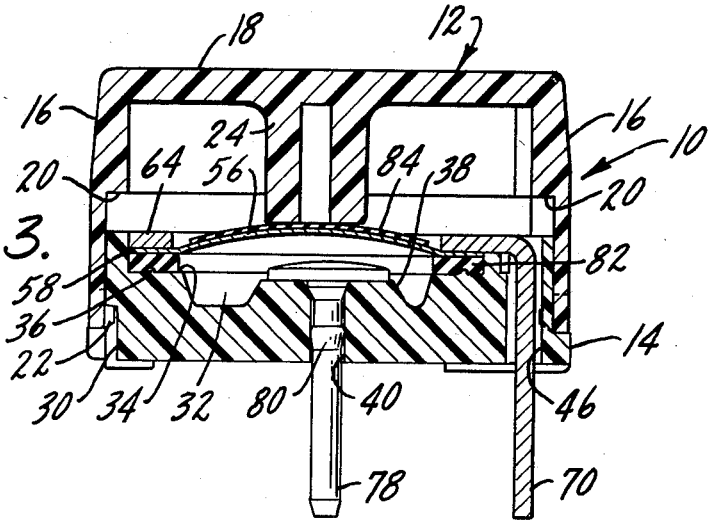
FIG. 3 is a section taken generally through the middle of a switch, as shown by line 3—3 in FIG. 1.

The assembled switch 10 is shown in FIG. 3. A stationary pin contact 78 is press fit through the hole 40 with the head of the pin resting on pedestal 38. The shaft of the pin contact has a tapered boss 80. The boss has a diameter slightly greater than that of the hole 40. This enables the pin to seal the hole against entry of any contaminates.

A gasket 82 is placed on top of the ledge 34. The gasket is an annular piece of silicone rubber. The movable contact and retainer assembly is placed on top of the gasket 82. The contact assembly is oriented such that the connection tabs 60 and 74 lie in the cutout portion 44 and the tabs 62 fit into the clearance notches 42. The legs 68 of the retainer 64 extend through the retainer slots 48 of the base. The legs are clinched on the underside of the base into the undercut portion 50. This is shown in FIG. 11. The electrical lead 70 extends through the hole 46. Thus with the legs 68 clinched on the underside of the base the gasket 82 is compressed between the flange 58 of the movable contact and the ledge 34. The bead 36 on the ledge enhances the seal formed by the gasket. It can be seen then that the portion of the well underneath the dome 56 is completely sealed. The openings for the electrical lead 70 and for the retainer legs 68 are all outside of the gasket 82. The only opening to the interior portion of the switch is the hole 40 and that is sealed by the boss 80 on the contact pin 78. This sealing arrangement eliminates the need for any kind of sealing agent in the holes through the base.

The use and operation of the switch are as follows. Electrical connections are made to the contact pin 78 and the lead 70. The switch is actuated by pressure on the button 12. The button slides on the base with the actuating member 24 in contact with a load spreading device 84. The load spreading device is a circular patch of rubber placed on top of the dome portion 56. Its use is optional. Its purpose is to spread the pressure of the actuating member throughout the surface of the dome portion of the contact. As the downstroke continues the dome portion of the movable contact snaps through center and into contact with the head of pin 78. When the pressure is removed from the button the dome snaps back to its initial position, lifting the button with it.

We claim:

1. An electric switch, comprising:

a base;

a pin contact extending in sealing relation through the base;

a movable contact including a central dome portion in spaced, facing relation with the pin contact;

a gasket between the periphery of the movable contact and the base; and retainer means urging the movable contact into sealing engagement with the gasket so as to completely seal the space between the dome portion of the movable contact and the base.

2. The structure of claim 1 wherein the retainer means includes at least two legs extending through the base, the legs being clinched on the underside of the base.

3. The structure of claim 1 or 2 wherein the retainer means includes an electrical lead for providing electrical connection to the movable contact.

4. The structure of claim 1 or 2 wherein the movable contact and the retainer means are spot-welded together.

5. The structure of claim 1 further characterized in that the base has a bead in contact with the gasket to improve the sealing characteristic of the gasket.

6. The structure of claim 1 further including a button, slidably engaging the base and having an actuating member which depresses the movable contact member in response to pressure on the exterior of the button.

7. The structure of claim 1 further including a load-spreading device in the form of a rubber patch on the dome portion of the movable contact.

8. The structure of claim 1 further characterized in that the retainer means is attached to the base at points outside the periphery of the gasket.

* * * * *